United States Patent [19]

Crockett

[11] 3,956,138

[45] May 11, 1976

[54] COMPOSITIONS OF FIRE-EXTINGUISHING FOAM CONCENTRATES AND METHOD OF USING THE SAME

[76] Inventor: Fred Benton Crockett, Rte. 3, Box 479E Dorwood Drive, Orlando, Fla. 32811

[22] Filed: Sept. 24, 1973

[21] Appl. No.: 399,915

[52] U.S. Cl. ..... 252/3; 252/8.05; 252/307

[51] Int. Cl.[2] ..... A62D 1/00

[58] Field of Search ..... 252/3, 8.05, 153, 307, 252/545, 553, 559

[56] References Cited

UNITED STATES PATENTS

| | | | |
|---|---|---|---|
| 3,457,172 | 7/1969 | Stewart et al. | 252/3 |
| 3,479,285 | 11/1969 | Barthauer | 252/3 |
| 3,562,156 | 2/1971 | Francen | 252/307 X |
| 3,579,446 | 5/1971 | Kroke et al. | 252/3 |
| 3,616,859 | 11/1971 | Shay et al. | 252/3 X |
| 3,634,233 | 1/1972 | Hiltz | 252/3 |
| 3,655,555 | 4/1972 | Rossmy et al. | 252/3 |
| 3,661,776 | 5/1972 | Fletcher | 252/8.05 X |
| 3,721,706 | 3/1973 | Hoffmann | 252/307 X |
| 3,772,195 | 11/1973 | Francen | 252/3 X |
| 3,839,425 | 10/1974 | Bartlett | 252/8.05 X |

*Primary Examiner*—Stephen C. Bentley
*Assistant Examiner*—Peter A. Nelson
*Attorney, Agent, or Firm*—Jesse C. Bowyer

[57] ABSTRACT

A foam concentrate comprising from about 7.5% to about 12% by weight of an anionic surfactant, from about 4% to about 9% by weight of an ammonium salt surfactant, from about 1% to about 8% by weight of a nonionic surfactant, up to about 5% by weight of a lipophilic agent, up to about 9% by weight of an alkoxylated ammonium alkyl sulfate and the balance being substantially water or other suitable non-flammable carrier diluent, when diluted with from about 33 to about 99 times its weight of water, is useful for extinguishing fires of Class A combustibles.

Those concentrates which contain at least 1% by weight of a lipophilic agent, when diluted similarly, yield foams which are useful for extinguishing Class B fires and mixed Class A and Class B fires. Concentrates containing at least 1% by weight of alkoxylated ammonium alkyl sulfate, when diluted with brackish, saline or hard water, yield foams which extinguish fires. Optimum and preferred ranges for the various components are given.

21 Claims, No Drawings

COMPOSITIONS OF FIRE-EXTINGUISHING FOAM CONCENTRATES AND METHOD OF USING THE SAME

BACKGROUND OF THE INVENTION

This invention relates to improved foam-producing materials which are useful for generating foam for atmospheric control in fire fighting. Fire fighting requires a "wet" foam material which retains a satisfactory water content for a considerable length of time and which forms individual bubbles which have maximum uniformity and retain their unburst form for as long as possible from a practical standpoint.

This invention relates particularly to the control of fires of two classifications: those of ordinary combustible solids, or Class A materials, which include materials such as wood, cotton, paper, etc.; and mixtures of Class A materials with Class B materials, which are flammable hydrocarbon liquids, such as gasoline, naphtha, hexane, benzene, toluene and the like.

It has been found that such foam, in order to have optimum effectiveness in putting out fires, must have a water content high enough to effect what is generally designated as a "smothering action" on the fire. This so-called "smothering action" does not mean that the foam material necessarily completely "wets" the fire, but only that enough water is entrained in the foam so that the foam will vaporize, at least in part, to form a blanket of steam, which blanket is confined by the foam in the vicinity of the fire and deprives the fire of the necessary amount of oxygen to sustain combustion.

THE PRIOR ART

The use of various surfactants as components of foams which are useful for extinguishing fires is well known in the art. However, the formulations known heretofore suffer from one or more serious disadvantages. Kelly et al., in U.S. Pat. No. 3,637,022, teach that a useful fire-retardant composition is an oil-external micellar dispersion containing 50–90% of water, 3–15% of surfactant and 4–40% of hydrocarbon. Although the dispersion is useful for extinguishing oil fires, it has the serious disadvantage of requiring large volumes of undiluted dispersion to extinguish fires and the further disadvantage that the components of the dispersion must be combined at the time of use.

Busse et al., in U.S. Pat. Nos. 2,506,062, 2,514,310, and 2,529,211, teach the preparation of foam-producing concentrates which contain surfactants such as sodium lauryl sulfate, copolymers of methyl vinyl ether and maleic anhydride, N-octyltaurine, sodium salt, carboxy-methylcellulose sodium salt, and the like. Although these materials are diluted with water during use, the recommended range of dilution is so low, e.g. about 16 (see U.S. Pat. No. 2,506,062), that unwieldy large volumes of concentrates must be handled.

In Potter U.S. Pat. No. 2,665,257, the combination of sodium lauryl sulfate, sodium dodecylbenzenesulfonate, sodium benzoate, a cellulose derivative, etc. is utilized to produce a bubble-forming liquid, when combined with water, is taught. However, Potter does not suggest that this composition is useful as a concentrate for a fire-extinguishing foam.

Bertsch U.S. Pat. No. 2,114,042 and Brandt U.S. Pat. No. 2,244,512 suggest, among a multiplicity of other uses, the use of alkylbenzenesulfonate salts in fire-extinguishing foams and Rossmy et al. in U.S. Pat. No. 3,655,555 show the combination of an ethoxylated fluoroamide derivative in a fire-extinguishing foam. It is apparent that all of these compositions have of necessity one or more deficiencies, including: excessive expense, incapability of ready dilution or concentrate storage, ineffectiveness for fire fighting, foam instability, improper size or non-uniform bubble size, etc.

Thus, there exists a continuing need for a foam concentrate which is stable on concentrate storage, is capable of facile dilution with extremely high volumes of water from various sources, possesses uniform size, stable, bubble forming ability, is relatively inexpensive, and whose fire smothering ability is substantially increased over the known art, whether diluted with relatively pure water, or diluted with water which is relatively high in saline content, such as sea water, brackish water or so-called "hard" water.

Moreover, there is also a continuing need for a foam concentrate which can be used with equal effectiveness on fires from both Class A and Class B combustibles, obviating the necessity of keeping separate concentrates for Class A and Class B fires.

OBJECTS OF THE INVENTION

The main object of this invention is to provide foam-producing concentrates which, even when diluted with extremely high volumes of water and applied to a fire, will effectively extinguish the fire.

A further object of this invention is to provide an economical, non-corrosive, stable concentrate for producing such foams.

A further object of this invention is to provide foam concentrates which will yield foams which are effective for extinguishing fires caused by the combustion of Class A and Class B materials, or mixtures thereof.

Another object of this invention is to provide such foam concentrates which can be diluted with distilled, tap, brackish, saline and hard waters to afford effective and economical, relatively stable fire-extinguishing foams.

SUMMARY OF THE INVENTION

Foam concentrates of this invention which are, upon water dilution, especially effective for extinguishing fires from Class A materials comprise solutions of from about 7.5% to about 12% by weight of an anionic surfactant, from about 4% to about 9% by weight of an ammonium salt surfactant, from about 1% to about 8% by weight of a nonionic surfactant, up to about 9% by weight of an alkoxylated ammonium alkyl sulfate and the balance being substantially water.

Foam concentrates of this invention which are, upon water dilution, particularly useful for extinguishing fires from Class B materials comprise solutions of from about 7.5% to about 12% by weight of an anionic surfactant, from about 4% to about 9% by weight of an ammonium salt surfactant, from about 1% to about 8% by weight of a nonionic surfactant, from about 1% to about 5% by weight of a lipophilic agent, up to about 9% by weight of an alkoxylated ammonium alkyl sulfate and the balance being substantially water.

The improved foam-producing materials of this invention, when diluted with from about 33 to about 99 parts of water per part of concentrate and mixed with air or other gases during propulsion from a tank or hydrant in the usual manner, are particularly effective for extinguishing fires.

In preparing the preferred concentrates for use to extinguish Class A fires, the amount of nonionic surfactant in the concentrate should be of the order of about 4% to about 6% by weight. The amount of anionic surfactant will preferably be in the range between about 9% and about 12% by weight and the amount of ammonium salt surfactant between about 5% and about 8%.

An extremely useful concentrate for dilution with water to put out Class A fires comprises about 10.5% by weight of the anionic surfactant, about 6% by weight of the ammonium salt surfactant, about 5% by weight of the nonionic surfactant and the balance essentially water.

In preparing preferred concentrates suitable for use on Class B fires and Class A - Class B fires, the amount of nonionic surfactant can be somewhat lower than in concentrates for Class A fires and is preferably within the range between about 2% and about 7% by weight.

In the preferred compositions adapted for use on Class B fires and mixed fires from Class A and Class B materials, the amount of nonionic surfactant will preferably be of the order of about 3% to about 5%. The amount of ammonium salt surfactant will be about 5% to about 8%, the amount of anionic surfactant between about 9% and about 12%, and the amount of lipophilic agent between about 2% and about 3%.

It will be understood that concentrates specifically formulated for use on Class B fires and on mixed Class A - Class B fires are equally effective, when diluted in accordance with the technique of this invention, in extinguishing fires originating from Class A materials exclusively.

For economy, it is recommended that the concentrates of this invention be diluted, as stated above, with from about 33 to about 99 parts by weight of water per part of concentrate. Thus, the foamed extinguishing media made from the concentrates of this invention will commonly be used at a level from about 1% to about 3% of concentrate. For most purposes, a level of about 1% is convenient.

The diluent for the foregoing concentrates is preferably tap water or deionized water. For economy, tap water as available at any hydrant is preferred.

Foam concentrates especially adapted for dilution with brackish water, sea water, mineral water, or hard water preferably contain from at least 1% up to about 9% by weight of alkoxylated ammonium alkyl sulfate. The preferred range of alkoxylated ammonium alkyl sulfate is between about 2% and about 5% by weight. Preferably, the amount of anionic surfactant is decreased in formulations intended for dilution with sea water or brackish water.

Thus, foam concentrates preferred for dilution with brackish water or sea water and application to Class A fires will preferably comprise from about 1% to about 4% by weight of the nonionic surfactant, from about 9% to about 12% by weight of the anionic surfactant, from about 5% to about 8% by weight of the ammonium salt surfactant, from about 2% to about 5% by weight of the alkoxylated ammonium alkyl sulfate and a small carrier amount of diluent, such as water, in this case from about 71% to about 83% by weight.

A foam concentrate for extinguishing Class A fires which is especially preferred for dilution with sea water, brackish water, and hard water contaminated by various metal cations comprises about 10.5% by weight of an anionic surfactant, about 6% by weight of an ammonium salt surfactant, about 2% by weight of nonionic surfactant, about 3% by weight of an alkoxylated ammonium alkyl sulfate and water or the like as diluent for handling or storage, said diluent being about preferably about 78.5%.

Concentrate compositions which are preferred for dilution with brackish, salt and hard water and application to Class B fires and fires from mixed Class A - Class B materials comprise from about 1% to about 3% by weight of a nonionic surfactant, from about 9% to about 12% by weight of an anionic surfactant, from about 3% to about 6% by weight of an ammonium salt surfactant, from about 2% to about 3% by weight of a lipophilic agent, from about 2% to about 5% by weight of an alkoxylated ammonium alkyl sulfate and water.

An especially preferred composition for dilution with brackish water and the like and application to fires originating from at least some Class B material comprises about 1% by weight of the nonionic surfactant, about 11.4% of the anionic surfactant, about 4.2% by weight of the ammonium salt surfactant, about 3% of the lipophilic agent, about 3% of alkoxylated ammonium alkyl sulfate and about 77.4% water.

It will be understood that, although concentrates formulated particularly for dilution with saline, brackish and hard water should contain at least about 1% by weight of the alkoxylated ammonium alkyl sulfate, such formulations are equally effective when diluted with distilled, deionized and soft waters.

Thus, concentrates of this invention comprising from about 7.5% to about 12% by weight of an anionic surfactant, from about 4% to about 9% by weight of an ammonium salt surfactant, from about 1% to about 8% by weight of a nonionic surfactant, from about 1% to about 5% by weight of a lipophilic agent, from about 1% to about 9% by weight of an alkoxylated ammonium alkyl sulfate and the balance being substantially water are effective, when diluted with water from any source, for extinguishing fires originating from either Class A or Class B substrates, or mixtures thereof.

In the most preferred embodiments of this invention, the concentrate comprises, in the proportions recited above, sodium lauryl sulfate as anionic surfactant, the triethanolamine salt of dodecylbenzenesulfonic acid as the ammonium salt surfactant, ethoxylated nonylphenol as the nonionic surfactant, butyl cellosolve as the lipophilic agent, ammonium lauryl ether sulfate as the alkoxylated ammonium alkyl sulfate and water.

The concentrates of this invention are readily converted into foam suitable for extinguishing fires by any known, standard mechanical methods, such as by entraining a gaseous medium, for example, air, into a moving stream of water into which the concentrates are introduced. In practice, the concentrates may be introduced into a flowing stream of water in which air or other gas is entrained. This may be done by use of any of the standard foam producing nozzles which suck in the air and the foam-generating material in such a manner that the latter is added to the stream of water in the desired dilution ratio. The foam may also be obtained by beating air into the solution with the desired amount of water. The gas, or other air, is introduced in standard amounts; in some cases standard hose equipment attached to a fire hydrant or the like inherently entrains a sufficient amount of gas to sustain a foam without the use of special means therefor.

It will be apparant that fire companies in different locations can use the concentrates of this invention in conjunction with the equipment available at their locations and that the uses of the foam concentrates of this invention are not limited to application with any particular type of apparatus.

The term "anionic surfactant" as used in the specification and claims refers to any of the naturally-derived or synthetic products characterized as alkali metal salts of carboxylic or sulfonic acids, or mixtures thereof. Among the naturally-derived products are the sodium and potassium salts of the higher fatty acids, such as stearic, palmitic, behenic, oleic, linoleic, and the like. Other anionic detergents are disclosed in McCutcheon's "Detergents and Emulsifiers", McCutcheon's Division of Allured Publishing Co., Ridgewood, New Jersey (1973 Annual).

Also within the definition of anionic surfactant are sodium and potassium alkylbenzenesulfonates. Another class of compounds useful as anionic surfactants for the practice of the invention are the alkali metal salts of the sulfated $C_{10} - C_{18}$ fatty alcohols, such as potassium lauryl sulfate, sodium lauryl sulfate, sodium cetyl sulfate, and the like.

The preferred class of anionic surfactants for the practice of this invention are the alkali metal salts of the sulfated fatty alcohols and their mixtures. Of these derivatives, sodium lauryl sulfate is especially preferred.

Sodium lauryl sulfate refers both to the pure compound and to the more commonly commercially available mixtures of sulfated fatty alcohols which contain predominantly $C_{12}$ compounds. The precursor alcohols for such compositions are, as is well known, commonly obtained from coconut and palm kernel oils or the like, and although lauryl alcohol is the major ingredient, myristyl, cetyl and stearyl alcohols are also frequently present, often along with other homologous lower alcohols.

Typical of the sodium lauryl sulfates useful in preparing the fire-extinguishing foam concentrates of this invention are the so-called Repowol NLS products sold by Rewo Chemicals, Inc. For example, NLS-30 and NLS-35 are pastes which contain about 30% and about 35%, respectively, by weight, of sodium lauryl sulfate. The balance is generally water. Another product usable in preparing these concentrates is NLS-90, a powder containing about 90% sodium lauryl sulfate. It will be apparent that the ratios set forth in the examples and claims are based on the actual or "real weight" amount of sodium lauryl sulfate per se in the concentrate, rather than on the amount of the overall material compositions in which they are sold, whether liquid or paste or powder.

"Ammonium salt surfactants", as used herein, includes salts of sulfonic acids and a tertiary amine. The useful sulfonic acids include aliphatic, aromatic, and alkylated aromatic sulfonic acids. Alkylated aromatic sulfonates useful in making these salts are set forth in the 1973 edition of McCutcheon's "Detergents and Emulsifiers". Amines which are useful for preparing the ammonium salt surfactants of this invention include substantially all of the tertiary amines. However, tertiary amines having a hydrophilic function in addition to the amino nitrogen are preferred. Typical of the prefrred amines are triethanolamine, ethoxylated amine derivatives, dimethylethanolamine, alkyldiethanolamines, and the like.

The preferred ammonium salt surfactant for the practice of this invention is the triethanolamine salt of dodecylbenzenesulfonic acids and mixtures thereof with other ammonium salt surfactants. Typical of the commercial compositions containing the triethanolamine salt of dodecylbenzenesulfonic acid and which may be used in the concentrates of this invention is Icowet TEA, a product of Whitestone Chemical Corporation, which contains 60% by weight of the salt, the remainder being substantially water. It will be understood that dodecylbenzenesulfonic acid generally refers to sulfonated branched-chain alkylbenzenes derived from the alkylation of benzene with propylene tetramer of butylene trimer.

"Nonionic surfactant", as used herein, refers generally to most of the ethoxylated or propoxylated alcohols available as surfactants. Typical examples of these materials are listed in the 1973 edition of McCutcheon's "Detergents and Emulsifiers".

The ethoxylated nonylphenols preferred for use in preparing the concentrates of this invention are those nonylphenols which have been ethoxylated with ethylene oxide so as to include an average chain length of about nine ethoxy groups. Because of the inherent difficulties in controlling the ethoxylation process, such ethoxylated nonylphenols are frequently not monodisperse, but, rather, are a mixture of ethoxylated nonylphenols having various molecular weights and structures. Typical of the commercially available ethoxylated nonylphenols useful in the practice of this invention is NP-9, a product of Whitestone Chemical Corporation, which has an average molecular weight of 618.

The term "lipophilic agent", as used herein, generally means any material which has an affinity toward hydrocarbon materials and toward water. Typical of these materials are the cellosolves and the carbitols. Of particular use in the practice of this invention are the $C_2 - C_6$ ethers of the cellosolve and carbitol series. Butyl cellosolve is especially preferred due to its non-flammable nature, it being understood that most fire codes forbid the addition to fire foam concentrates of any materials which are readily burnable.

As used in the specification and claims, "alkoxylated ammonium alkyl sulfate" means $[R\text{-}(O\text{-}CH_2CH_2)_n\text{-}SO_4\text{-}]^-NH_4^+$, wherein R is a $C_{10} - C_{14}$ straight or branched chain alcohol residue and $n$ is an integer from 1 to 4. These compounds are generally obtained by ethoxylation of an alcohol with ethylene oxide to the desired degree of ethoxylation followed by sulfation and, thereafter, conversion to an ammonium salt.

Typical of the alkoxylated ammonium alkyl sulfates operable in the practice of this invention are Maprofix MB and MBO, which are products of Onyx Chemical Company. Maprofix MB and MBO are reported to be ammonium lauryl ether sulfate. Each of these liquid products is about 30% real, the remainder being generally water. Other suitable products for the practice of this invention are AL-3 and MA-360, ammonium lauryl ether sulfates distributed by the Cycryl Company of Miami, Florida. These products are about 60% real, the remainder being generally water, it being understood that the preferred alkoxylated ammonium alkyl sulfate for the practice of this invention is ammonium lauryl ether sulfate.

In defining the water of dilution used in preparing fire-extinguishing foams from the concentrates of this invention, "hard" water is the term generally used to refer to water which contains a relatively high salt concentration including dissolved common salt and compounds of calcium, magnesium and iron. The amount of such material one liter of average well water contains generally from 0.1 to 0.5 grams. Waters having higher amounts of such dissolved inorganic material are commonly known as "mineral" waters.

Generally, salt water, such as ocean water, contains somewhat more than 3.5% of dissolved mineral matter, the following being a typical distribution:[a]

| | |
|---|---|
| sodium chloride | 77.76% |
| magnesium chloride | 10.88 |
| magnesium sulfate | 4.74 |
| calcium sulfate | 3.60 |
| potassium sulfate | 2.46 |
| magnesium bromide | 0.22 |
| calcium carbonate | 0.34 |
| | 100.00% |

[a]E. Mack, Jr., et al., "Textbook of Chemistry", Ginn and Co., New York (1949), at 108.

"Brackish" water varies in composition in different sections of the country, but generally corresponds to a hybrid between well water containing between 0.1 and 0.5 grams per liter of sodium, calcium, magnesium, and iron salts and salt water containing up to 35 grams per liter of such contaminants.

"Soft" water, for the purposes of this disclosure, refers to well water containing about 0.1 grams per liter of dissolved salts, whereas the above-described hard waters contain up to about 0.5 gram or more of dissolved salts per liter.

Although no speculation is made as to the exact mechanism or mechanisms involved, the addition of at least 1% by weight of the alkoxylated ammonium alkyl sulfate to the formulations of this invention, as described in detail herein, has the effect of giving extremely stable fire-extinguishing foams, regardless of whether or not the water of dilution is hard, brackish, mineral or saline. Thus, the preferred compositions are, as stated, compatible with the readily available diluent water irrespective of geographical point of use; this makes possible, by means of the present invention as described in detail herein, the manufacture and sale of single formulation compositions, equally effective in any customer locale.

The present invention is not restricted to any exact foam structure. However, the successful use of the concentrates of this invention in extinguishing fires of both Class A and Class B materials makes it apparent that the products of this invention function in a manner similar to known fire-extinguishing foams, regardless of their exact, foamed in situ structures.

The following examples are illustrative of the invention described herein. It is to be understood that these examples are not intended to limit the scope of the invention.

EXAMPLE 1

Foam concentrates suitable for use in extinguishing Class A fires were prepared by combining and stirring the indicated ingredients until a homogeneous mixture was obtained:

| | Formulation (Parts %) | | | | | |
|---|---|---|---|---|---|---|
| Charge | A | B | C | D | E | F |
| Sodium lauryl sulfate | | | | | | |
| NLS-30[a] | 35.0 | | | 36.5 | 25.0 | 40.0 |
| NLS-35[b] | | 30.0 | 30.0 | | | |
| Triethanolamine salt[c] | 10.0 | 10.0 | 11.0 | 10.0 | 7.0 | 14.0 |
| Nonylphenol[d] | 5.0 | 5.0 | 5.0 | 5.0 | 2.0 | 8.0 |
| Water | 50.0 | 55.0 | 54.0 | 48.5 | 66.0 | 38.0 |
| | 100.0 | 100.0 | 100.0 | 100.0 | 100.0 | 100.0 |
| | Weight Percent Surfactant | | | | | |
| Sodium lauryl sulfate | 10.5 | 10.5 | 10.5 | 11.0 | 7.5 | 12.0 |
| Triethanolamine salt | 6.0 | 6.0 | 6.6 | 6.0 | 4.2 | 8.4 |
| Nonylphenol | 5.0 | 5.0 | 5.0 | 5.0 | 2.0 | 8.0 |
| | 21.5 | 21.5 | 22.1 | 22.0 | 13.7 | 28.4 |

[a]30% real
[b]35% real
[c]Triethanolamine salt of dodecylbenzenesulfonic acid, Icowet TEA, 60% real
[d]Ethoxylated nonylphenol, NP-9, 100% real

EXAMPLE 2

The formulation made according to "A" in Example 1 was tested by the Pine Castle Fire Department in Orlando, Florida by diluting one part of the foam concentrate with 50 parts of hydrant water. The resulting foam was especially effective in extinguishing fires of ordinary combustible materials, that is, Class A fires.

The formulations of Example 1 can be used at dilutions of one part of the foam concentrate and 33–99 parts of water to afford foams suitable for extinguishing Class A fires.

EXAMPLE 3

Formulations suitable for use in extinguishing Class B fires and fires from mixtures of Class A and Class B materials were made by combining and stirring the following components until a homogeneous mixture was obtained.

| | Formulation (Parts %) | | | | |
|---|---|---|---|---|---|
| Charge | A | B | C | D | E |
| Sodium lauryl sulfate | | | | | |
| NLS-30 | 35.0 | | | 25.0 | 40.0 |
| NLS-35 | | 30.0 | 30.0 | | |
| Triethanolamine salt (60% real) | 10.0 | 10.0 | 11.0 | 14.0 | 7.0 |
| Nonylphenol | 4.0 | 4.0 | 3.5 | 2.0 | 8.0 |
| Butyl cellosolve | 3.0 | 3.0 | 2.5 | 5.0 | 2.0 |
| Water | 48.0 | 53.0 | 53.0 | 54.0 | 43.0 |

-continued

| Charge | Formulation (Parts %) A | B | C | D | E |
|---|---|---|---|---|---|
| | 100.0 | 100.0 | 100.0 | 100.0 | 100.0 |
| | Weight Percent Surfactant | | | | |
| Sodium lauryl sulfate | 10.5 | 10.5 | 10.5 | 7.5 | 12.0 |
| Triethanolamine salt | 6.0 | 6.0 | 6.6 | 8.4 | 4.2 |
| Nonylphenol | 4.0 | 4.0 | 3.5 | 2.0 | 8.0 |
| Butyl Cellosolve | 3.0 | 3.0 | 2.5 | 5.0 | 2.0 |
| | 23.5 | 23.5 | 23.1 | 22.9 | 26.2 |

The formulation made according to "A" was tested by an official Fire Department on oil fires, following dilution with 50 parts of hydrant water per part of concentrate. The resulting foam extinguished such oil fires, as well as fires from oil and Class A combustibles.

Concentrates made according to any of the foregoing formulations can be diluted with from 33 to 99 parts of water to afford foams which extinguish Class B fires and mixed Class A - Class B fires.

EXAMPLE 4

Typical of the formulations which can be made for dilution with brackish or salt water to extinguish fires of Class B and mixed Class A - Class B origin are the following:

| Charge | Formulation (Parts %) A | B | C | D | E |
|---|---|---|---|---|---|
| Sodium lauryl sulfate | | | | | |
| NLS-30 | 36.5 | | 35.0 | 33.5 | 38.0 |
| NLS-35 | | 30.0 | | | |
| Triethanolamine salt (60% real) | 11.0 | 10.0 | 10.5 | 9.5 | 7.0 |
| Nonylphenol | 4.0 | 3.25 | 1.5 | 3.25 | 1.0 |
| Ammonium lauryl ether sulfate[a] | 2.0 | 5.0 | 8.0 | 6.0 | 5.0 |
| Butyl cellosolve | 3.0 | 3.0 | 3.0 | 2.0 | 3.0 |
| Water | 43.5 | 48.75 | 42.0 | 45.75 | 46.0 |
| | 100.0 | 100.00 | 100.0 | 100.00 | 100.0 |
| | Weight Percent Surfactant | | | | |
| Sodium lauryl sulfate | 10.9 | 10.5 | 10.5 | 10.1 | 11.4 |
| Triethanolamine salt | 6.6 | 6.0 | 6.3 | 5.7 | 4.2 |
| Nonylphenol | 4.0 | 3.25 | 1.5 | 3.25 | 1.0 |
| Ammonium lauryl ether sulfate | 1.2 | 3.0 | 4.8 | 3.6 | 3.0 |
| Butyl cellosolve | 3.0 | 3.0 | 3.0 | 2.0 | 3.0 |
| | 25.7 | 24.75 | 26.1 | 24.65 | 22.6 |

[a]AL-3, a product of Cycryl Company, Miami, Florida, 60% real

Formulation "E" was tested by an official Fire Department on oil fires, following dilution with 50 parts of brackish Florida water per part of concentrate. The resulting foam extinguished such oil fires, as well as fires from mixed Class A and Class B combustibles.

Any of the above formulations may be diluted with from about 33 to about 99 parts of distilled water, tap water, sea water, brackish water or hard water per part of concentrate to provide foams effective for putting out fires containing at least some Class B combustible material.

EXAMPLE 5

Typical of formulations intended for dilution with sea water, brackish water or hard water to extinguish fires containing Class A materials exclusively are the following:

| Charge | Formulation (Parts %) A | B | C | D | E |
|---|---|---|---|---|---|
| Sodium lauryl sulfate | | | | | |
| NLS-30 | 35.0 | | 25.0 | 40.0 | |
| NLS-35 | | 30.0 | | | 30.0 |
| Triethanolamine salt (60% real) | 10.0 | 11.0 | 14.0 | 7.0 | 10.0 |
| Nonylphenol | 4.0 | 2.5 | 2.0 | 6.0 | 2.0 |
| Ammonium lauryl ether sulfate (60% real) | 5.0 | 7.0 | 3.0 | 3.0 | 5.0 |
| Water | 46.0 | 49.5 | 56.0 | 44.0 | 53.0 |
| | 100.0 | 100.0 | 100.0 | 100.0 | 100.0 |
| | Weight Percent Surfactant | | | | |
| Sodium lauryl sulfate | 10.5 | 10.5 | 7.5 | 12.0 | 10.5 |
| Triethanolamine salt | 6.0 | 6.6 | 8.4 | 4.2 | 6.0 |
| Nonylphenol | 4.0 | 2.5 | 2.0 | 6.0 | 2.0 |
| Ammonium lauryl ether sulfate | 3.0 | 4.2 | 1.8 | 1.8 | 3.0 |

-continued

| Charge | Formulation (Parts %) A | B | C | D | E |
|---|---|---|---|---|---|
| | 23.5 | 23.8 | 19.7 | 24.0 | 21.5 |

Any of the foregoing concentrates can be diluted with from about 33 to about 99 parts of sea water, hard water or brackish water per part by weight of concentrate to produce foam which will extinguish fires originating from Class A materials.

EXAMPLE 6

Foam stability tests were performed by charging 100 milliliters of sea water and 3 milliliters of the selected foam concentrate to an optically-clear graduated glass container 12 inches in height and 3 inches in diameter. The samples were agitated by shaking manually for 30 seconds. The height of the foam (in inches) was measured from the bottom of the container to the top of the foam. The drain back was measured and timed in minutes.

A concentrate designated as No. 595 and comprising 4% of ammonium lauryl ether sulfate (60% real), 10% of the triethanolamine salt of dodecylbenzene-sulfonic acid (60% real), 35% of sodium lauryl sulfate (30% real), 2% of ethoxylated nonylphenol, 3% of butyl cellosolve and 46% of water was evaluated with the following results:

| Drain Time (minutes) | Milliliters | Foam (inches) |
|---|---|---|
| 0 | | 7 |
| 4 | 81 | 6¼ |
| 7 | 90 | 6 |
| 10 | 91 | 5½ |
| 15 | 92 | 5¼ |
| 20 | 93 | 5¼ |

EXAMPLE 7

A foam concentrate designated as No. 253 and corresponding to the composition set forth in Example 3A gave the following results:

| Drain Time (minutes) | Milliliters | Foam (inches) |
|---|---|---|
| 0 | | 6 |
| 4 | 76 | 5½ |
| 7 | 89 | 5½ |
| 10 | 93 | 5¼ |
| 15 | 94 | 5¼ |
| 20 | 95 | 5 |

EXAMPLE 8

A concentrate designated as No. 605, which falls within the limits set forth in the foregoing disclosure, gave the following results:

| Drain Time (minutes) | Milliliters | Foam (inches) |
|---|---|---|
| 0 | | 8½ |
| 4 | 74 | 7½ |
| 7 | 87 | 7½ |
| 10 | 89 | 7¼ |
| 15 | 90 | 7¼ |

-continued

| Drain Time (minutes) | Milliliters | Foam (inches) |
|---|---|---|
| 20 | 91 | 7 |

What is claimed is:

1. A fire-extinguishing foam concentrate which comprises from about 7.5% to about 12% by weight of an anionic surfactant, from about 4% to about 9% by weight of a sulfonated amine salt surfactant, from about 1% to about 8% by weight of a nonionic surfactant, from 0 to about 5% by weight of a lipophilic agent, from 0 to about 9% by weight of an alkoxylated ammonium alkyl sulfate and the balance being substantially non-flammable diluent.

2. The concentrate of claim 1, wherein said diluent is substantially water.

3. A concentrate of claim 2, wherein said water is selected from the group consisting of pure, soft, hard, brackish and sea water.

4. A concentrate of claim 1, wherein the amount of anionic surfactant is between about 9% and about 12% by weight, the amount of sulfonated amine salt surfactant is between about 5% and about 8% by weight and the amount of nonionic surfactant is between about 4% and about 6% by weight.

5. The concentrate of claim 1, wherein the anionic surfactant is sodium lauryl sulfate, the sulfonated amine salt surfactant is the triethanolamine salt of dodecylbenzenesulfonic acid and the nonionic surfactant is ethoxylated nonylphenol.

6. The concentrate of claim 1, wherein the amount of anionic surfactant is between about 9% and about 12% by weight and the anionic surfactant is sodium lauryl sulfate, the amount of sulfonated amine salt surfactant is between about 5% and about 8% by weight and the sulfonated amine salt surfactant is the triethanolamine salt of dodecylbenzenesulfonic acid and the amount of nonionic surfactant is between about 4% and about 6% by weight and the nonionic surfactant is ethoxylated nonylphenol.

7. The concentrate of claim 1, comprising about 10.5% by weight of sodium lauryl sulfate, about 6% by weight of the triethanolamine salt of dodecylbenzenesulfonic acid, about 5% by weight of ethoxylated nonylphenol and water.

8. The concentrate of claim 1, wherein the amount of alkoxylated ammonium alkyl sulfate is between about 1% and about 9% by weight.

9. The concentrate of claim 1, wherein the amount of alkoxylated ammonium alkyl sulfate is between about 2% and about 5% by weight and the alkoxylated ammonium alkyl sulfate is ammonium lauryl ether sulfate.

10. The concentrate of claim 1, wherein the amount of lipophilic agent is between about 1% and about 5% by weight.

11. The concentrate of claim 1, wherein the amount of lipophilic agent is between about 1% and about 5% by weight and the lipophilic agent is butyl cellosolve.

12. The concenrate of claim 1, wherein the amount of anionic surfactant is between about 9% and about 12% by weight and the anionic surfactant is sodium lauryl sulfate, the amount of ammonium salt surfactant is between about 5% and about 8% by weight and the ammonium salt surfactant is the triethanolamine salt of dodecylbenzenesulfonic acid, the amount of nonionic surfactant is between about 4% and about 6% by weight and the nonionic surfactant is ethoxylated nonylphenol and the amount of alkoxylated ammonium alkyl sulfate is between about 1% and about 9% by weight.

13. The concentrate of claim 12, wherein the alkoxylated ammonium alkyl sulfate is ammonium lauryl ether sulfate.

14. The concentrate of claim 1, wherein the amount of anionic surfactant is between about 9% and about 12% by weight the amount of sulfonated amine salt surfactant is a tertiary aromatic sulfonated amine between about 5% and about 8% by weight, the amount of nonionic surfactant is between about 4% and about 6% by weight, the amount of alkoxylated ammonium alkyl sulfate is between about 2% and about 5% by weight and the amount of lipophilic agent is between about 1% and about 5% by weight.

15. The concentrate of claim 1, wherein the amount of anionic surfactant is between about 9% and about 12% by weight and the anionic surfactant is sodium lauryl sulfate, the amount of sulfonated amine salt surfactant is between about 5% and about 8% by weight and the ammonium salt surfactant is the triethanolamine salt of dodecylbenzenesulfonic acid, the amount of nonionic surfactant is between about 4% and about 6% by weight and the nonionic surfactant is ethoxylated nonylphenol, the amount of alkoxylated ammonium alkyl sulfate is between about 2% and about 5% by weight and the alkoxylated ammonium alkyl sulfate is ammonium lauryl ether sulfate and the amount of lipophilic agent is between about 1% and about 5% by weight and the lipophilic agent is butyl cellosolve.

16. The concentrate of claim 1, comprising about 10.5% by weight of the anionic surfactant, about 6% by weight of the sulfonated amine salt surfactant, about 2% by weight of the nonionic surfactant, about 3% by weight of the alkoxylated ammonium alkyl sulfate and water.

17. The concentrate of claim 1, comprising about 11.4% by weight of the anionic surfactant, about 4.2% by weight of the sulfonated amine salt surfactant, about 1% by weight of the nonionic surfactant, about 3% by weight of the alkoxylated ammonium alkyl sulfate, about 3% by weight of the lipophilic agent and water.

18. A method of extinguishing a fire, which comprises the steps of 1. mixing one part of a fire-extinguishing concentrate comprising from about 7.5% to about 12% by weight of an anionic surfactant, from about 4% to about 9% by weight of sulfonated amine salt surfactant, from about 1% to about 8% by weight of a nonionic surfactant, from 1% to about 5% by weight of a lipophilic agent, from 1% to about 9% by weight of an alkoxylated ammonium alkyl sulfate and the balance being substantially from about 33 to about 99 parts of non-flammable diluent in the presence of suitable bubble-forming gas to produce fire-extinguishing foam, and
2. applying the product of step (1) to a fire of materials selected from the group of Class A and Class B combustibles and mixtures thereof.

19. The concentrate of claim 1 wherein said sulfonated amine is a salt of the reaction product of a tertiary amine and an aromatic sulfonic acid.

20. The method of claim 18, wherein the amount of alkoxylated ammonium alkyl sulfate in the concentrate is between about 1% and about 9% by weight and water of dilution is selected from sources consisting of saline, brackish and hard water.

21. The method of claim 18, wherein the amount of alkoxylated ammonium alkyl sulfate in the concentrate is between about 2% and about 5% by weight and the alkoxylated ammonium alkyl sulfate is ammonium lauryl ether sulfate and water of dilution is selected from sources consisting of saline, brackish and hard water.

* * * * *